US005275019A

United States Patent [19]

Pagani

[11] Patent Number: 5,275,019

[45] Date of Patent: Jan. 4, 1994

[54] FUNCTIONAL RING

[75] Inventor: Carlo Pagani, Grumello Del Monte, Italy

[73] Assignee: C.T.P. S.p.A., Grumello Del Monte, Italy

[21] Appl. No.: 899,263

[22] Filed: Jun. 16, 1992

[30] Foreign Application Priority Data

Jun. 26, 1991 [IT] Italy ..... M191 A 001761

[51] Int. Cl.[5] ..... A44C 9/00

[52] U.S. Cl. ..... 63/15; 63/1.1; 446/26; 359/802; 359/815; 359/440

[58] Field of Search ..... 63/15, 1.1, 2, DIG.; 446/26, 219; 359/802, 803, 809, 811, 815, 816, 436, 440

[56] References Cited

U.S. PATENT DOCUMENTS

| | | | |
|---|---|---|---|
| D. 70,276 | 6/1926 | Hammond | 63/15 |
| 1,536,365 | 5/1925 | Wiseman | 359/815 |
| 1,548,646 | 8/1925 | Akeson | 63/15 |
| 2,234,942 | 3/1941 | Nichols | 359/809 |
| 2,502,328 | 3/1950 | Kuhn | 359/809 |
| 2,584,087 | 6/1952 | Barbieri | 63/1.1 |
| 4,133,603 | 1/1979 | Inouye | 359/815 |
| 4,764,140 | 8/1988 | Wood | 63/15 |

FOREIGN PATENT DOCUMENTS

| | | | |
|---|---|---|---|
| 2410979 | 8/1979 | France | 63/15 |

OTHER PUBLICATIONS

Deutsche Goldschmiede Leitung "Entwicklungsarbeiten und Experimente" von Friedrich Becker Jul. 1959.

*Primary Examiner*—Peter M. Cuomo
*Assistant Examiner*—Flemming Saether
*Attorney, Agent, or Firm*—Eckert Seamans Cherin & Mellott

[57] ABSTRACT

A functional ring having the particular characteristic of comprising, in various forms of decorative elements indicative of cardinal orientation or temperature, as well as differently formed lens elements in order to confer a true and proper utility to an object. Specifically, a ring is disclosed including a solid transparent sphere for magnification of objects seen therethrough.

2 Claims, 2 Drawing Sheets

Fig. 1
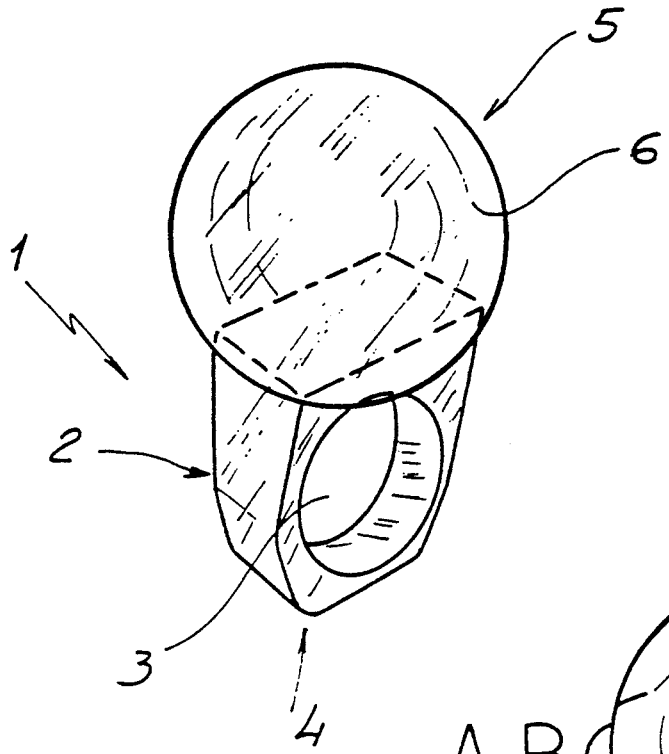
Fig. 2
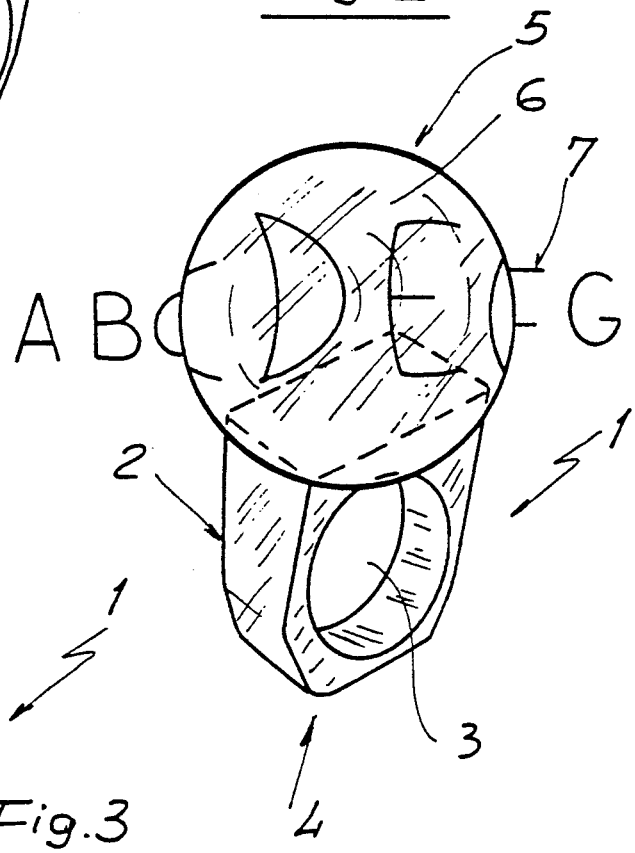
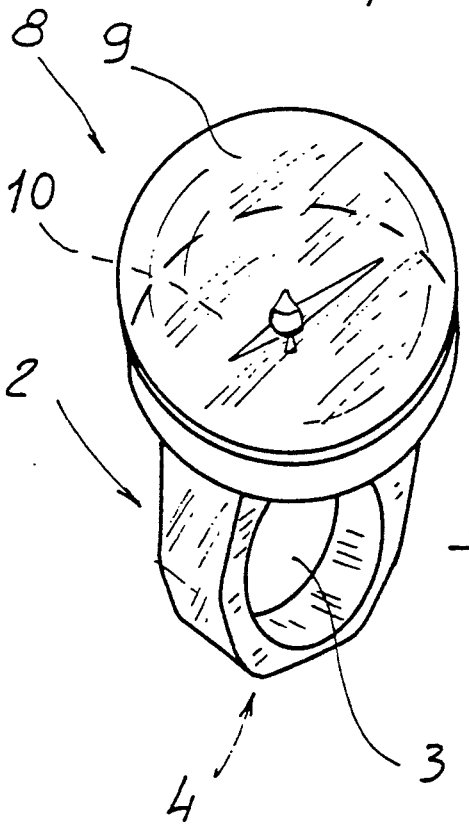
Fig. 3

FUNCTIONAL RING

This invention refers to a ring with functional characteristics connected to various types of utilisation, according to the forms realised.

It is known that in the last few years rings made in non-precious plastic-type materials and various alloys have become widespread with various aesthetic forms connected mostly to fashion trends and market demand.

In this field however rings which unite a functional use to the aesthetic aspect have not been made.

The object of this invention is to create a ring which, in its various forms of embodiment, complies with functional needs, such as that of a magnifying lens, a compass, a reflecting prism, a spinning top, a pendulum and numerous other uses which the user may devise.

These and other particular functional characteristics in various forms of embodiment, will be highlighted more clearly in the following detailed description, made purely as an example and not limiting the scope of the invention, with the aid of various figures in the appended sheets of drawings, in which:

FIG. 1 shows a perspective view of a ring in spherical form, according to a first form of embodiment;

FIG. 2 shows purely as an example, the spherical ring functionally used as a lens for observing some written letters, by enlarging them;

FIG. 3 shows a perspective view of a ring having a compass, according to a second form of embodiment;

Figure 4:
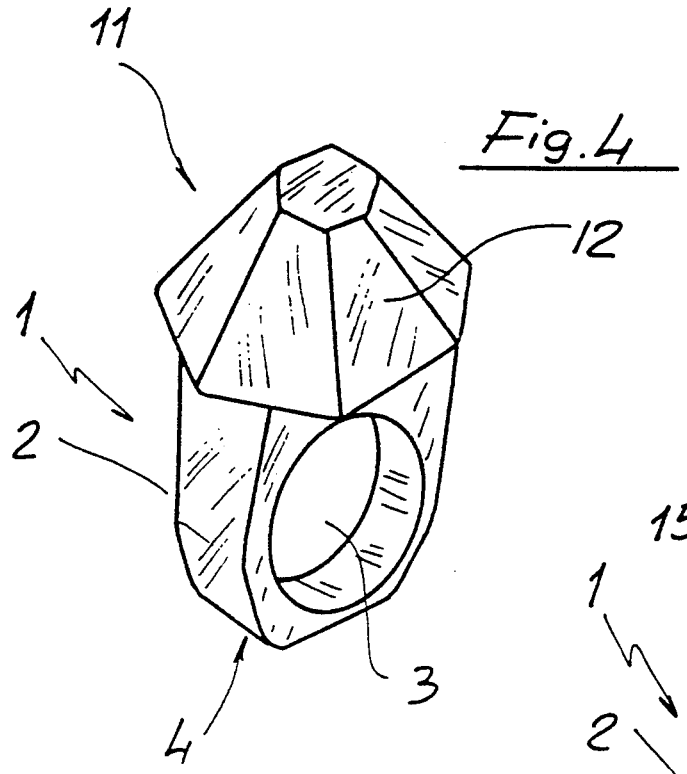
FIG. 4 shows a ring with a prismatic form, according to a third form of embodiment.

With reference to FIG. 1, the ring 1 in question generally made in transparent material, comprises a lower part 2 with a hole 3 for putting the finger through, variously shaped and tapered towards the area 4 which interacts with the palm of the hand.

Above this is functional part 5 which, in this form of embodiment, is constituted by a sphere 6 which has the characteristic of being able to be used as a magnifying lens by placing it directly on the detail to be observed, as it is illustratively represented in FIG. 2 for rows of writing 7, or for example it may be used to examine the fibres of fabrics.

Referring to FIG. 3, according to a second form of embodiment, the ring 1 in question has an upper part 8 with a spherical cap 9 in which a compass 10 is enclosed.

With reference to FIG. 4, according to a third form of embodiment, the upper part 11 of the ring is formed as a truncated conical prism 12 which, in the presence of light sources, reflects various light effects.

Figure 5:
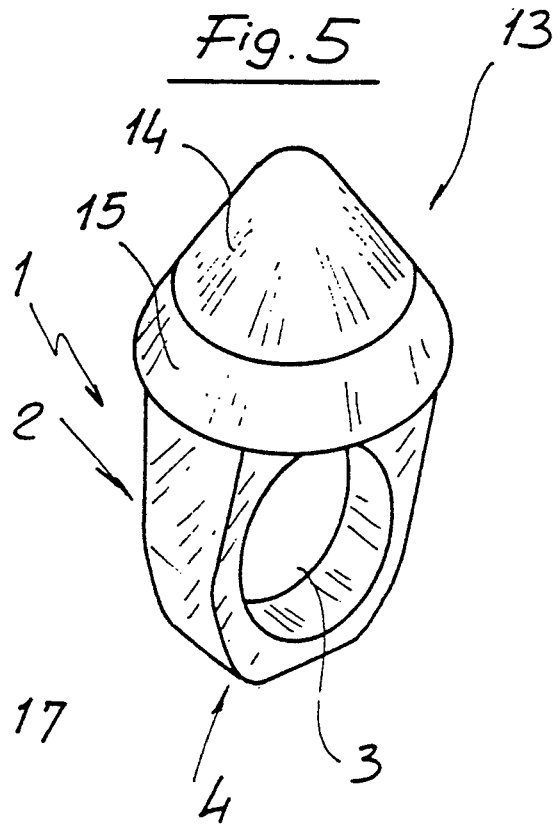
FIG. 5 shows a ring with a conical decorated form according to a fourth form of embodiment.

With reference to FIG. 5, according to a fourth form of embodiment, upper part 13 of the ring is constituted by a conical element 14 placed on top of a first truncated conical element 15 made preferably in transparent material but of different colours, in order to reflect light of different chromatic tones.

Figure 6:
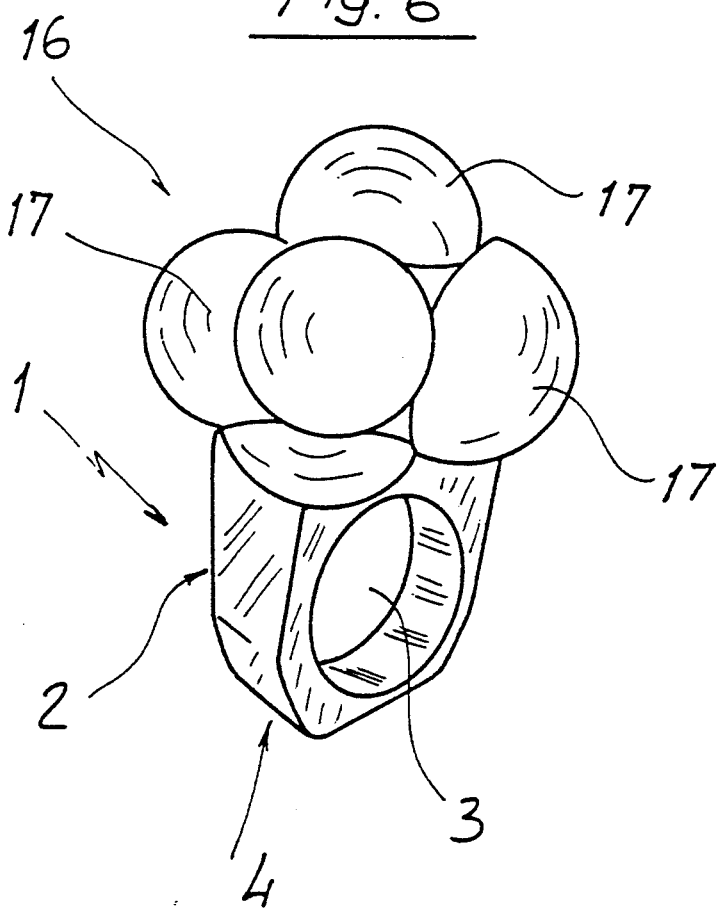
FIG. 6 shows a ring with a series of semirounded faces according to a fifth form of embodiment.

With reference to FIG. 6, according to a further form of embodiment, the ring 1 in question comprises an element 16 composed of half-spheres 17 connected to each other in order to obtain a variable chromatic and reflective composition.

The functional ring according to this invention also lends itself to numerous other uses, such as a spinning top for playing various types of games, a magic pendulum when it is suspended from a string or a chain, and other uses which the imagination and the ingenuity of the user can devise.

Obviously, all the forms of embodiment cited represent only some significant examples of the vast range of forms and colours which can be created always taking into consideration the functional factor of the same.

One must finally emphasize the fact that these forms of embodiment do not limit the scope of the invention, but on the contrary one must understand that numerous additions, variations, modifications and substitutions of elements may be brought to this invention without thus altering either its spirit or its object, nor leaving its scope of protection, as shown by the appended claims.

I claim:

1. A functional ring to be worn on a finger of a wearer, comprising:

an annular band for encircling the finger of the wearer;

a completely transparent solid plastic upper part affixed to the band, said transparent solid upper part formed as a completely clear sphere protruding from the annular band above the wearer's finger, the sphere being operable to magnify items viewed diametrically therethrough.

2. Functional ring according to claim 1, wherein said ring is weighted by said upper part relative to said annular band for use as at least one of a spinning top and a pendulum.

* * * * *